US005458561A

United States Patent [19]

Schweisfurth

[11] Patent Number: 5,458,561

[45] Date of Patent: Oct. 17, 1995

[54] MASSAGE DEVICE

[76] Inventor: Günter Schweisfurth, Am Glaskopf 76, 57567 Daaden, Germany

[21] Appl. No.: 226,543

[22] Filed: Apr. 12, 1994

[30] Foreign Application Priority Data

Apr. 15, 1993 [DE] Germany ..... 43 12 326.0
Dec. 23, 1993 [EP] European Pat. Off. ..... 93120696

[51] Int. Cl.[6] ..... A61H 15/00

[52] U.S. Cl. ..... 601/119; 601/123; 601/19

[58] Field of Search ..... 601/119, 122, 601/123, 124, 125, 126, 128, 129, 118, 115, 141

[56] References Cited

U.S. PATENT DOCUMENTS

| | | | |
|---|---|---|---|
| 1,513,475 | 3/1923 | Bell . | |
| 1,615,910 | 2/1927 | Nuyts | 601/129 |
| 1,910,490 | 9/1930 | Lucas . | |
| 2,193,249 | 3/1940 | Flanders | 601/123 |
| 2,572,627 | 10/1951 | Kelly | 601/125 |
| 3,104,662 | 9/1963 | Morawetz | 601/125 |
| 4,101,971 | 7/1978 | Schuler | 601/122 |
| 4,683,875 | 8/1987 | Rabinowitz | 601/141 |
| 4,744,350 | 5/1988 | Sato | 601/119 |

FOREIGN PATENT DOCUMENTS

| | | | |
|---|---|---|---|
| 0282173 | 9/1988 | European Pat. Off. . | |
| 0336641 | 10/1989 | European Pat. Off. . | |
| 0142132 | 5/1990 | European Pat. Off. . | |
| 0465758 | 1/1992 | European Pat. Off. . | |
| 1218923 | 12/1959 | France . | |
| 850781 | 9/1952 | Germany . | |
| 36174 | 8/1985 | Germany . | |
| 9010455 | 12/1990 | Germany | 601/123 |

*Primary Examiner*—Robert A. Hafer
*Assistant Examiner*—David J. Kenealy
*Attorney, Agent, or Firm*—Friedrich Kueffner

[57] ABSTRACT

A massage device for the rolling massage of skin areas and reflex zones of the human body includes a shaft mounted on a handle and massage rings or rolling bodies which are freely rotatably mounted on the shaft. The massage rings or rolling bodies have projections which are uniformly distributed in circumferential direction. Preferably, the projections are needle tips. A connection is provided between the shaft supporting the massage rings or rolling bodies and the handle which is elastically yielding or resilient at least to a limited extent.

10 Claims, 3 Drawing Sheets

MASSAGE DEVICE

BACKGROUND OF THE INVENTION

1. Field of the Invention

The present invention relates to a massage device for the rolling massage of skin areas and reflex zones of the human body. The massage device includes a shaft mounted on a handle and massage rings or rolling bodies which are freely rotatably mounted on the shaft. The massage rings or rolling bodies have projections which are uniformly distributed in circumferential direction. Preferably, the projections are needle tips.

2. Description of the Related Art

A massage device of the above-described type is already known from EP-Bi-O 142 132. This known massage device has been found very useful in practical application. This is because the massage device has an effect which is like that of acupuncture; in other words, the massage device provides a point-by-point effect and, therefore, can be used in self-treatment for carrying out a rolling massage of skin areas and reflex zones. It is important in this connection that the skin stimulations produced by the rolling massage frequently make it possible to achieve favorable therapeutic effects if a good surface massage is carried out at aching body areas and/or the respective reflex zones.

In the known massage device described above, the handle and the shaft with the massage rings or rolling bodies are connected through a transverse joint, so that the angle between the handle and the shaft is adjustable out of the axially aligned position at least to a limited extent. The reason for this adjustability is that it makes possible an optimum surface rolling massage in self-treatment even at those aching body areas or reflex zones to be treated when they are not easily accessible, for example, in the area of the back. The hand holding and/or guiding the massage device can carry out the necessary movements without having to assume extreme positions which would make a desirable intensive manipulation difficult and, thus, would impair the therapeutic effect.

A massage device of the above-described type is disclosed in DE-U-90 10 455 and EP-A1-0 465 758. In that massage device, the shaft supporting the massage rings or rolling bodies is arranged on the side of the handle in a fork-shaped member which is pivotally connected to the handle by means of a pivoting axis. The pivoting axis is arranged in the middle of the fork-shaped member and, thus, in the middle of the massage rings or rolling bodies.

The above-described configuration of the massage device is intended to make it possible that it can be used simply and effectively even on body areas which are more curved without the danger of injury to the skin. This massage device, which constitutes a modification as compared to the massage device discussed first, has primarily the purpose that the handle has such a distance from the body area to be treated that contact of the skin by the handle is excluded during massaging. The pivoting suspension of the shaft supporting the massage rings or rolling bodies on the side of the handle is to make it possible that the position of the handle is automatically adapted to the curvature of the skin areas to be massaged even when the angular position of the handle is constant, so that a good contact of the massage rings or rolling bodies on the skin is ensured.

In practical use of massage devices of the type mentioned last, it has been found that in most cases of application, the therapeutic effect which can be achieved with the massage device of the type described first, cannot be achieved or can only be achieved to a limited extent by the massage device of the type mentioned last. This is because the contact pressure exerted through the shaft on the massage rings or rolling bodies by the handle on the skin areas or body areas to be treated is exactly achieved practically only in the immediate vicinity of the pivoting axis, i.e., in the region of a plane of action extending through the pivoting axis and intersecting at a right angle the shaft supporting the massage rings or rolling bodies. On the other hand, at all locations remote from this plane of action, the contact pressure deviates from the desired value in the positive and/or negative sense to a greater or lesser extent and, thus, significantly impairs the desirable advantageous therapeutic effect as it can be achieved with the massage device of the type mentioned first which has been proved effective in practical use.

SUMMARY OF THE INVENTION

Therefore, it is the primary object of the present invention to make it possible to improve the sensitivity or sensibility when handling the massage device, independent of whether the massage device is one or the other of the two above-described types of massage devices.

In other words, the contact force exerted by the handle on the massage device should not only be distributed as uniformly as possible over the entire length of the shaft supporting the massage rings or rolling bodies; rather, the effect of the massage device on the body areas and/or reflex zones to be treated should have the optimum dosage. Accordingly, the system for transmitting the force from the handle to the shaft supporting the massage rings or rolling bodies should include a sensory mechanism which produces the therapeutically most effective pressure acting on the skin areas and reflex zones to be treated from the needle pins provided as projections on the massage rings or rolling bodies.

In accordance with the present invention, the above-described objects are met in a surprisingly simple manner by providing a connection between the shaft supporting the massage rings or rolling bodies to the handle which is elastically yielding or resilient at least to a limited extent.

The degree of elasticity $\mu_e$ of the connection which is yielding to a limited extent can be adjusted to the requirements for obtaining the desired therapeutic effect by an appropriate material selection and/or shape of the operational components forming the connection.

In a massage device in which the shaft supporting the massage rings or rolling bodies is arranged on the side of the handle in a fork-shaped member movably connected to the shaft, the concept of the invention can be realized in a simple manner by providing a support connection which is elastically yielding to a limited extent between the fork-shaped member and the handle.

The present invention further provides that the support connection is formed by an elastomer block which rests against the fork-shaped member, on the one hand, and against the handle, on the other hand. However, the support connection can also be formed by at least one spring which rests against the fork-shaped member, on the one hand, and against the handle, on the other hand, wherein the spring may be formed, for example, by a plurality of helical compression springs or by a leaf spring stirrup.

In accordance with a particularly advantageous embodiment of the massage device according to the present invention, the fork-shaped member with the elastomer block and/or the springs is received in a laterally open pocket or recess of the handle. This embodiment is advantageous because the fork-shaped member receives an exact support guidance within the pocket in the direction of two space dimensions, so that undesirable forces acting from the sides are prevented from reaching the elastomer block and/or the springs. As a result, it is possible that the fork-shaped member and the handle are in operative connection exclusively through the elastomer block and/or the springs.

However, in some cases it may also be advantageous if, in accordance with another feature of the present invention, the fork-shaped member is mounted in the pocket by means of bolts extending through longitudinal slots. In that case, it is possible to place the elastomer block and/or springs loosely or releasably within the pocket between the fork-shaped member and the handle, so that the elastomer block and/or the springs can be exposed and exchanged by removing the bolts from the longitudinal slots. Thus, it is possible, by an appropriate selection of the elastomer block and/or the springs, to vary the degree of elasticity of the fork-shaped member relative to the handle.

The present invention further provides that at least two-fork shaped members with massage rings or rolling bodies can be arranged in the handle one behind the other so as to be movable independently of each other.

In accordance with another particularly advantageous feature, the leaf spring stirrup producing the elastically yielding support of the massage rings or rolling bodies has an approximately W-shaped basic shape and rests with bent free ends of its two outer sides against the bottom of the pocket or against adjusting screws mounted in the pocket. In addition, the leaf spring stirrup includes an upwardly bent flat trapezoidally shaped middle portion which is positively engaged by a hump which projects from the back of the fork-shaped member and is located preferably in a longitudinal groove of the fork-shaped member for providing a lateral guidance of the leaf spring stirrup.

A leaf spring stirrup configured and arranged in this manner has over the entire length thereof a uniform material cross section and, thus, has an optimum durability, i.e., it is virtually impossible that the stirrup will break under the influence of alternating loads occurring during use of the massage device.

Also within the scope of the present invention are massage devices of the type in which a connecting portion of the handle with the shaft is constructed so as to be bending elastic.

In accordance with a further development, the connecting portion of this type of massage device between the handle and shaft is composed of an elastomer portion and/or of bending rod springs.

On the other hand, in accordance with another feature, the handle can be provided in a length portion adjacent the shaft with transverse indentations arranged alternatingly on opposite sides and offset relative to each other in longitudinal direction, such that the respective length portion has a zig zag-shaped or wave-shaped diameter reduction which produces the desired bending elasticity.

In massage devices of the above-described type in which the angle of the handle relative to the shaft supporting the massage rings or rolling bodies is adjustable to a limited extent through a transverse joint, it is recommended in accordance with another feature to provide the transverse joint between the handle and the shaft with an elastic support, for example, with a spring element or an elastomer cushion.

Finally, in accordance with another advantageous feature, a treatment of the skin areas or body areas which takes place over a relatively large area and simultaneously, can be achieved by mounting in the handle a larger number of fork-shaped members with massage rings or rolling bodies in several rows which extend parallel to each other, wherein the massage rings or rolling bodies are movable independently of each other. A particularly useful massage device has been found to be one in which three rows of fork-shaped members with massage rings or rolling bodies are mounted in the handle, wherein, for example, two fork-shaped members are arranged in axial direction next to each other in the first row and in the third row, while only one fork-shaped member is arranged in the second or middle row and the fork-shaped member in the middle row is staggered relative to the fork-shaped members in the two other rows.

In accordance with a particularly useful feature, the larger number of fork shaped members may be supported in a base plate, wherein the handle projects transversely of and from the middle of the base plate.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
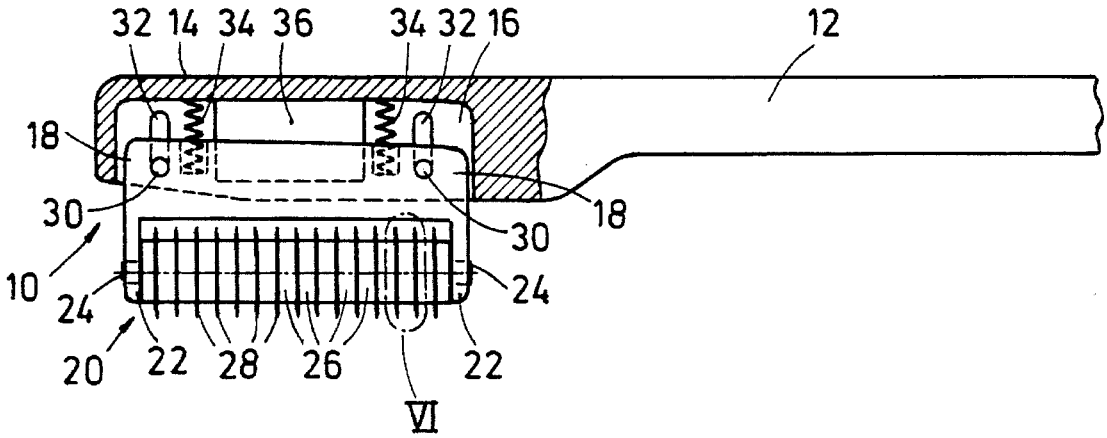
FIG. 1 is a side view, partially in section, of a first embodiment of the massage device according to the present invention.

FIG. 1 of the drawing shows a massage device 10 which includes a handle 12 whose front end 14 has an increased thickness or raised configuration. A pocket 16 which is open toward one longitudinal side is formed in the increased thickness or raised end 14. A fork-shaped member 20 is guided with a block-like rear portion 18 in the pocket 16. The two sides 22 of the fork-shaped member 20 support a shaft 24. A large number of massage rings or rolling bodies 26 are freely rotatably mounted on the shaft 24. Each of the massage rings or rolling bodies 26 has a plurality of projections 28 which form needle pins and are arranged uniformly distributed over the circumference of the massage rings or rolling bodies 26. At least each of the projections 28 of the massage rings or rolling bodies constructed as a needle pin is provided with a coating of noble metal, for example, silver or gold.

A significant structural feature of the massage device 1 shown in FIG. 1 is that the block-like rear portion 18 of the fork-shaped member 20 is received by the pocket 16 of the handle 12 in such a way that the rear portion 18 can be displaced to a limited extent in the pocket 16 of the handle 12 only parallel to its principal plane and essentially transversely of the shaft 24. For this purpose, in the embodiment of FIG. 1, the fork-shaped member 20 interacts with the front end 14 of the handle 12 through bolts 30 which extend through oblong holes 32 in transverse direction. In accordance with FIG. 1, the bolts 30 are inserted in holes of the block-like rear portion 18 and interact with oblong holes 32 provided in side walls of the front end 14 which define the pocket 16. Of course, the reverse arrangement of bolts 30 and oblong holes 32 is also possible.

In the massage device 10 shown in FIG. 1, the fork-shaped member 20 interacts with the front end 14 of the handle 12 through two bolts 30 and corresponding oblong holes 32. It would also be conceivable instead to provide only one bolt 30 with a corresponding oblong hole 32 and to arrange these operational elements at half the length of the fork-shaped member 20 and the pocket 16.

Another significant structural feature of the massage device 10 of FIG. 1 is that the shaft 24 supporting the massage rings or rolling bodies 26 is held in the handle 12 through a support connection which is at least to a limited extent elastically yielding or resilient in a direction extending transversely of the longitudinal direction thereof. In order to form this elastically yielding support connection, it is possible to mount a plurality of helical compression springs 34 between the block-like rear portion 18 of the fork-shaped member 20 and the bottom of the pocket 16 at the front end 14 of the handle 12. In the embodiment shown in FIG. 1, for example, two helical compression springs 34 are provided near the support connection formed by bolts 30 and oblong holes 32. In accordance with an advantageous feature, the helical compression springs 34 are received in blind-end holes which are open at the rearward end surface of the block-like rear portion 18.

By releasing the support connection formed by bolts 30 and oblong holes 32, it is possible to expose the helical compression springs 34 and to replace them with other helical compression springs having a different spring force if it is desired to vary the intensity of the elastically yielding connection.

In order to form the connection which is elastically yielding to a limited extent it is also possible to use an elastomer block 36 instead of or in addition to the helical compression springs 34. This elastomer block 36 is also mounted between the block-like rear portion 18 of the fork-shaped member 20 and the bottom of the pocket 16 in the front end 14 of the handle 12. The elastomer block 36 may also be partially received in a recess which is open toward the rearward end face of the block-like rear portion 18. The material of the elastomer block 36 may be foamed rubber or a similar material which can be compressed without significantly increasing its restoring force.

Figure 2:
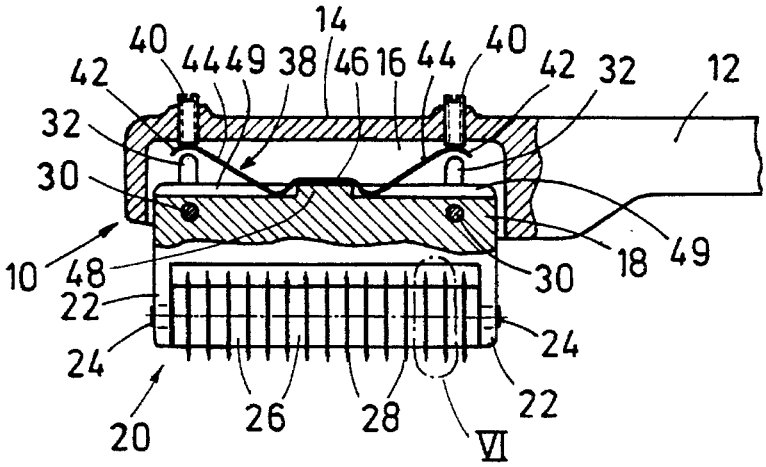
FIG. 2 is a side view, partially in section, of a second embodiment of the massage device according to the present invention.

FIG. 2 of the drawing shows a massage device 10 which is essentially of the same construction as the massage device 10 shown in FIG. 1. The only difference is that, instead of the helical compression springs 34 or the elastomer block 36 for forming the connection which is elastically yielding at least to a limited extent, a leaf spring stirrup 38 is used which is placed in the pocket 16 and rests against the bottom of the pocket 16, on the one hand, and against the rearward end face of the block-like rear portion 18, on the other hand. The use of leaf spring stirrups 38 as elastically yielding support elements is particularly recommended if it is desired to vary the elastic behavior. This is because it is possible in this case that adjusting screws 40 are provided in the bottom of the pocket 36 for influencing the elastic pretension of the leaf spring stirrups 38.

It has been found particularly useful in practice if the leaf spring stirrup 38 has an approximately W-shaped basic configuration and the bent free ends 42 of the two sides 44 of the stirrup 38 are supported by the bottom of the pocket 16 or by the adjusting screws 40 mounted in the bottom of the pocket 16. The stirrup 38 further has a relatively flat and trapezoidally shaped outwardly bent middle portion 46 which is positively engaged by a hump 48 which protrudes from the back of the block-shaped rear portion 18 of the fork-shaped member 20. The hump 48 is preferably located in the area of a longitudinal groove which serves to laterally guide the leaf spring stirrup 38 and which is formed in the rear surface of the block-shaped rear portion 18. It is only under the influence of its pretension that the leaf spring stirrup 38 is permanently held in its proper position of operation between the bottom of the pocket 16 and the back of the fork-shaped member 20.

Since a leaf spring stirrup constructed and arranged in this manner has a uniform material cross section over the entire length thereof, it has an optimum durability, i.e., it is virtually impossible that the stirrup will break under the influence of the alternating loads occurring during use.

Figure 3:
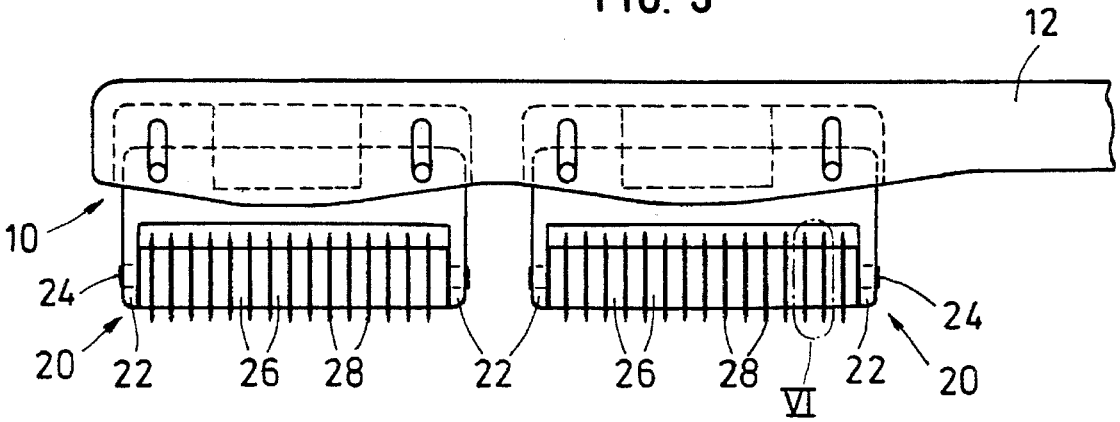
FIG. 3 is a side view of a further development of the massage devices of FIGS. 1 and 2.

In the massage devices 10 shown in FIGS. 1 and 2, each handle 12 is equipped with only one fork-shaped member 20 which carries the shaft 24 with the massage rings or rolling bodies 26. FIG. 3, on the other hand, shows an embodiment of the massage device 10 in which the handle 12 is equipped with two fork-shaped members 20 each of which has a shaft 24 supporting the massage rings or rolling bodies 26 with the projections 28 constructed as needle pins, wherein the shafts 24 are mounted between the sides 22 of the two fork-shaped members 20.

In the embodiment of FIG. 3, each of the two fork-shaped members 20 is individually connected to the handle 12 in the same manner which is elastically yielding to a limited extent, as is the case in the embodiments of FIGS. 1 and 2.

The interaction of the fork-shaped members 20 with the handle 12 can also be achieved in a manner which differs from that shown in FIGS. 1 and 2. Thus, the support connections formed by the bolts 30 and the oblong holes 32 can be replaced by providing cap bolts which extend in the front end 14 of the handle 12 through holes in the bottom of the pocket 16 and which are anchored in the block-like rear portion 18 of the fork-shaped member 20. These cap bolts can be arranged, for example, in axial alignment with the helical compression spring 34.

On the other hand, it is also possible to glue the elastomer block 36 to the bottom of the pocket 16, on the one hand, and to the fork shaped member 20, on the other hand, in order to obtain an undetachable but elastically yielding support connection of the fork shaped member 20 with the handle 12.

Figure 4:
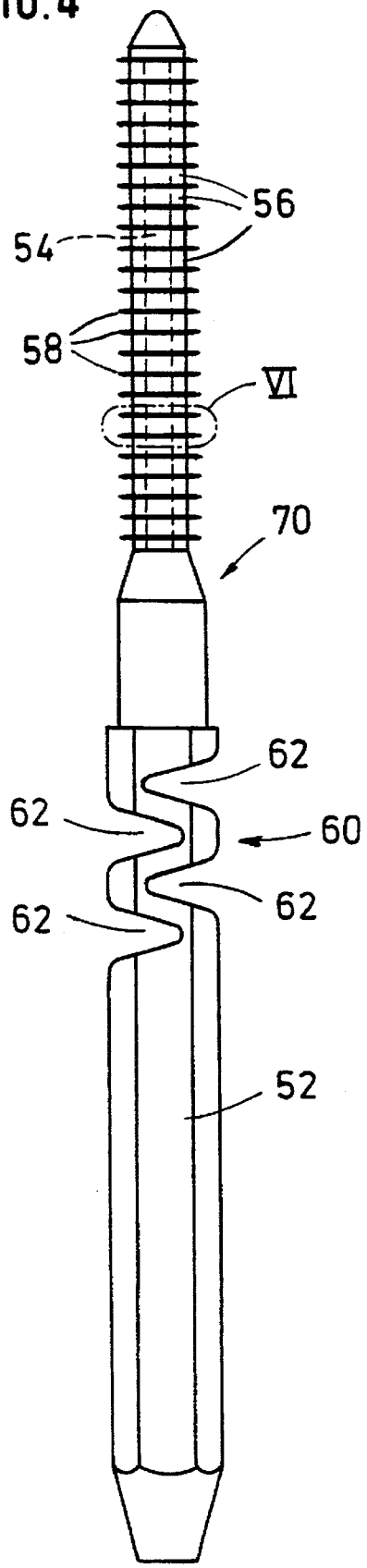
FIG. 4 is a side view of another embodiment of the massage device of the present invention.

FIG. 4 of the drawing shows an embodiment of the massage device 50 according to the present invention which is provided with a rod-shaped handle 52 which supports a shaft 54 on which are mounted a plurality of freely rotatably supported massage rings or rolling bodies 56. Each of the massage rings or rolling bodies 56 is provided with projections 58 in the form of needle pins which are uniformly distributed over the circumference of the massage ring or rolling body 56, wherein at least the needle pins have a surface coating of noble metal, such as silver or gold.

The significant feature of the massage device 50 of FIG. 4 is that the connecting portion 60 between the handle 53 and the shaft 54 supporting the massage rings or rolling bodies 56 has a bending-elastic configuration.

The bending-elastic configuration can be achieved, for example, by constructing the connecting portion 60 of an elastomer portion and/or of bending rod springs.

However, FIG. 4 of the drawing shows an embodiment in which the connecting portion 60 between the handle 52 and the shaft 53 is provided with transverse indentations 62 which are arranged on alternating sides and offset relative to each other in longitudinal direction. The transverse indentations 62 diverge from the inside toward the outside in the shape of a wedge or V and define over the connecting portion 60 a zig-zag shaped or wave-shaped shaft portion having a substantially reduced effective cross section. This provides the handle 52 through the connecting portion 60 with a certain bending elasticity, even if the material, particularly plastics material, used for manufacturing the handle 52 is in itself relatively rigid. The elastically yielding behavior of the connecting portion 60 can be influenced as desired by an appropriate positioning and configuration of the transverse indentations 62.

Figure 5:
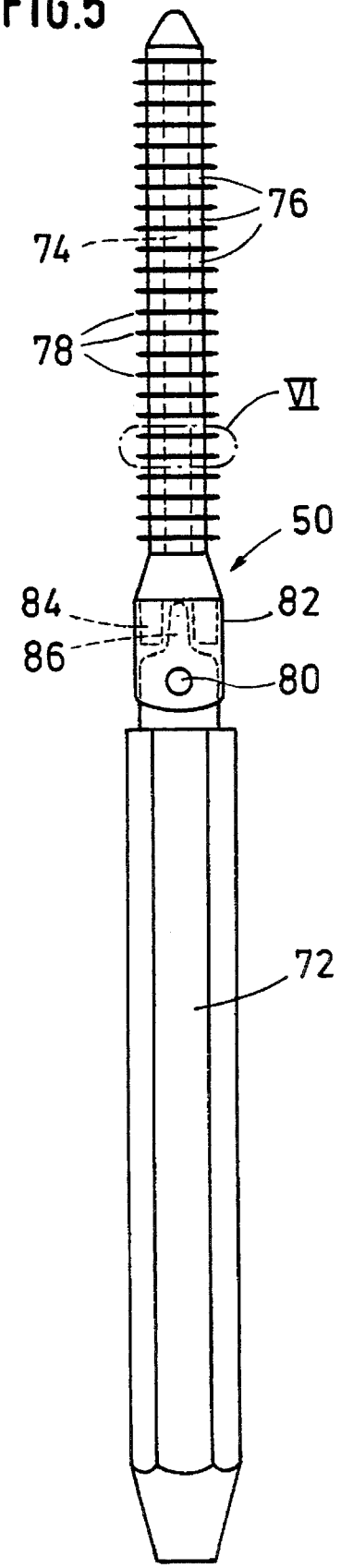
FIG. 5 is a side view of yet another embodiment of the massage device.

The massage device 70 shown in FIG. 5 is structurally very similar to the massage device 50 of FIG. 4. The rod-shaped handle 72 of the massage device 50 supports the shaft 74 on which the massage rings or rolling bodies 76 are freely rotatably mounted, wherein each massage ring or rolling body 76 has projections 78 in the form of needle pins which are arranged uniformly distributed over the circumference of the massage ring or rolling body 76.

However, the massage device 70 of FIG. 5 differs from the massage device 50 of FIG. 4 in that the shaft 74 is connected to the handle 72 through a transverse joint 80. This transverse joint 80 provides the shaft 74 with a certain angular mobility relative to the handle 72. This angular mobility is used in the present case for obtaining between the shaft 74 and the handle 72 a connection which is elastically yielding at least to a limited extent. For this purpose, on the side of the transverse joint 80 facing the shaft 74, a tubular elastomer body 84 is received in a sleeve member 82, wherein a tongue 86 projecting from the handle 72 engages in the tubular elastomer body 84.

The elasticity inherent in the elastomer body 84 determines the extent of the angular displacement of the shaft 74 about the transverse joint 80 relative to the handle 72 when a pressure is exerted from the handle 72 on the shaft 74 supporting the massage rings or rolling bodies 76.

It is understood that the drawing and the above description are directed only to examples of the invention and that the invention is not limited to these embodiments. Rather, the present invention is directed to all massage devices of the above-described type in which the shaft supporting the massage rings or rolling bodies is connected to the handle by means of a connection which is elastically yielding at least to a limited extent in a direction extending transversely of the longitudinal direction.

Figure 6:
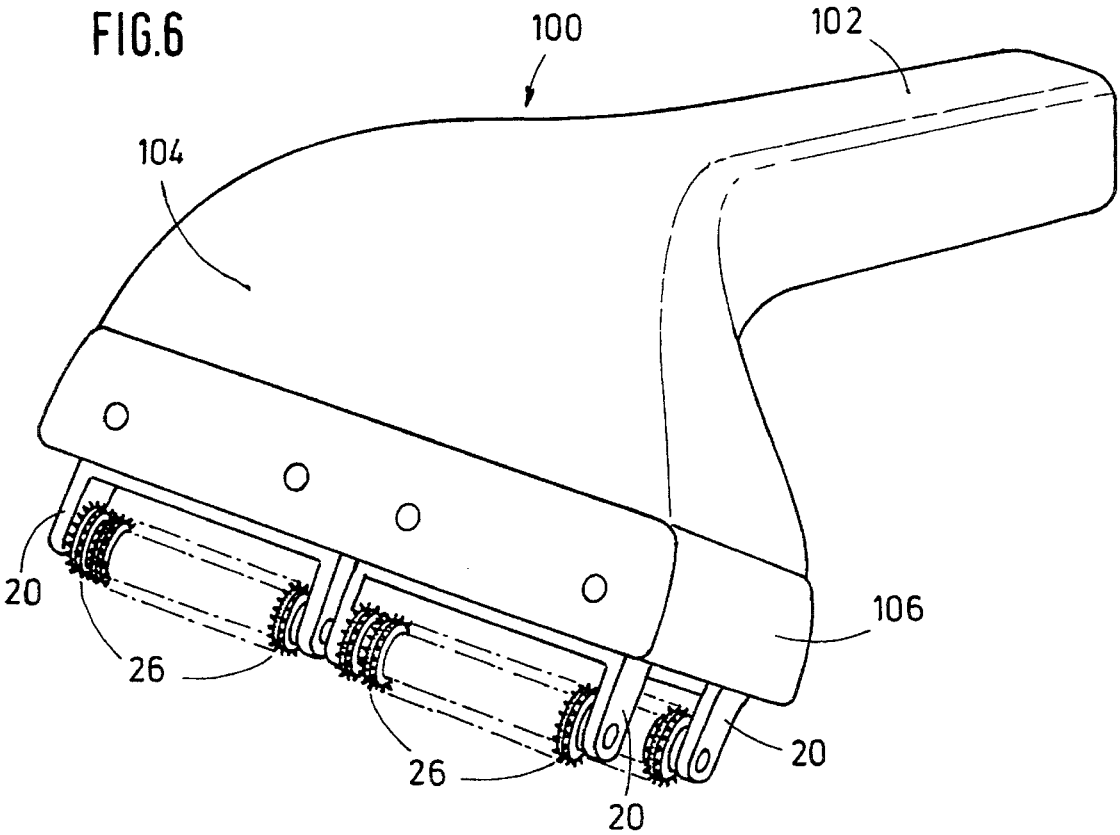
FIG. 6 is a perspective front view of a further embodiment of the massage device of the present invention.

FIG. 6 of the drawing shows a massage device 100 in which a front piece 104 with a base plate 106 is integrally connected to a handle 102. The base plate 106 extends in a plane underneath the handle 102 and at a relatively acute angle relative to the principal direction of extension of the handle 102.

Figure 7:
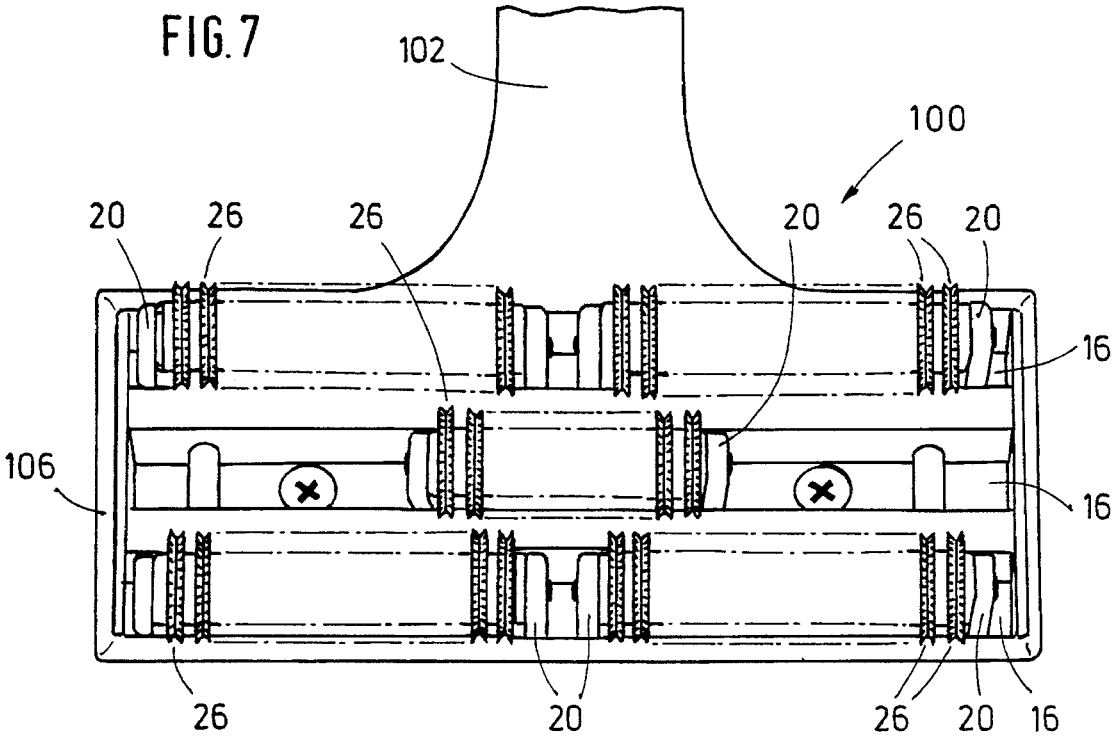
FIG. 7 is a partial bottom view of the massage device of FIG. 6.

Similar to the increased thickness or raised end 14 of the massage device 10 according to FIGS. 1–3, the base plate 106 at the front piece 104 of the handle 102 of the massage device 100 also has downwardly open pockets 16, as can be seen in FIG. 7 of the drawing. As shown in FIG. 7, the base plate 106 is equipped with three pockets 16 which extend parallel to each other. In the front and rear pockets 16, two fork-shaped members 20 each with massage rings or rolling bodies 26 are arranged next to each other in axial direction, while only one fork-shaped member 20 with massage rings or rolling bodies 26 is arranged in the middle pocket 16. The fork-shaped member 20 with the massage rings or rolling bodies 26 in the middle pocket 16 is arranged staggered relative to the two fork-shaped members 20 arranged in the first and last pocket 16 of the base plate 106, as can be clearly seen in FIG. 7.

It should be pointed out that the fork shaped members 20 with the shafts supporting the massage rings or rolling bodies 26 are suspended within the pockets 16 in the embodiment of the massage device 100 shown in FIGS. 6 and 7 in the same manner as already described above in connection with FIGS. 1 to 3 of the drawing. However, the special feature of the massage device 100 shown in FIGS. 6 and 7 resides in that the number of fork-shaped members 20 with massage rings or rolling bodies 26 has been increased in order to facilitate an efficient and simultaneous treatment of relatively large skin or body areas. Since each fork-shaped member 20 with the massage rings or rolling bodies 26 is individually movably suspended in the pockets 16 of the base plate 106, it is ensured that the sensitivity and sensibility of the manipulation of the massage device is maintained even when treating large areas of the skin or body.

The invention is not limited by the embodiments described above which are presented as examples only but can be modified in various ways within the scope of protection defined by the appended patent claims.

I claim:

1. A massage device for carrying out a rolling massage of skin areas and reflex zones of the human body, the massage device comprising a handle, a shaft having a longitudinal direction, and a plurality of ring-shaped rolling bodies freely rotatably mounted on the shaft, each rolling body having a plurality of projections uniformly distributed in a circumferential direction thereof, the projections comprising needle tips, further comprising a fork-shaped member, the shaft being mounted in the fork-shaped member, the handle comprising a laterally open pocket, the fork-shaped member being received in the pocket, the fork-shaped member defining oblong slots, the pocket having projecting bolts engaging in the oblong slots, a support connection being mounted between the fork-shaped member and the handle, the support connection being elastically yielding at least to a limited extent in a direction extending transversely of the longitudinal direction of the shaft, wherein the support connection comprises at least one spring within the pocket in contact with the fork-shaped member and the handle.

2. The massage device according to claim 1, further comprising at least one additional fork-shaped member, and a shaft with ring-shaped rolling bodies mounted in the additional fork-shaped member, the additional fork-shaped member being received in an additional pocket of the handle, wherein the fork-shaped members are arranged in axial alignment on the handle and wherein the fork-shaped members are movable independently of each other.

3. The massage device according to claim 1, comprising a plurality of fork-shaped members, each fork-shaped member receiving a shaft with ring-shaped rolling bodies rotatably mounted on each shaft, further comprising a base plate, the base plate having a center and a transverse direction, the handle being connected to the base plate so as to extend from the center and in transverse direction, the base plate comprising a plurality of pockets, the fork-shaped members being received in the pockets, the fork-shaped members defining oblong slots and the pockets having projecting bolts engaging in the oblong slots, wherein the fork-shaped members are arranged on the base plate in at least two rows extending parallel to each other.

4. The massage device according to claim 3, wherein the fork-shaped members are arranged in three rows on the base plate, and wherein two fork-shaped members each are arranged in axial direction next to each other in two outer rows and one fork-shaped member is arranged in a middle row and staggered relative to the fork-shaped members of the outer rows.

5. The massage device according to claim 1, wherein the spring is a leaf spring stirrup having an approximately W-shaped basic shape and comprising outer sides with free ends and a flat trapezoidally shaped upwardly bent middle portion connecting the outer sides, the pocket having a bottom, the free ends being bent and resting against the bottom, the fork-shaped member having a back and a hump protruding from the back, the middle portion being in positive engagement with the hump, further comprising adjusting screws mounted in the bottom of the pocket, the free ends of the leaf spring stirrup being in contact with the adjusting screws, wherein the fork-shaped member has a longitudinal groove for laterally guiding the leaf spring stirrup, the hump being located in the longitudinal groove.

6. A massage device for carrying out a rolling massage of skin areas and reflex zones of the human body, the massage device comprising a handle, a shaft having a longitudinal direction, and a plurality of ring-shaped rolling bodies freely rotatably mounted on the shaft, each rolling body having a plurality of projections uniformly distributed in a circumferential direction thereof, the projections comprising needle tips, further comprising a fork-shaped member, the shaft being mounted in the fork-shaped member, the handle comprising a laterally open pocket, the fork-shaped member being received in the pocket, the fork-shaped member defining oblong slots, the pocket having projecting bolts engaging in the oblong slots, a support connection being mounted between the fork-shaped member and the handle, the support connection being elastically yielding at least to a limited extent in a direction extending transversely of the longitudinal direction of the shaft, wherein the support connection comprises at least one elastomer block received in the pocket, and wherein the elastomer block is in contact with the fork-shaped member and the handle.

7. The massage device according to claim 6, further comprising at least one additional fork-shaped member, and a shaft with ring-shaped rolling bodies mounted in the additional fork-shaped member, the additional fork-shaped member being received in an additional pocket of the handle, wherein the fork-shaped members are arranged in axial alignment on the handle and wherein the fork-shaped members are movable independently of each other.

8. The massage device according to claim 6, comprising a plurality of fork-shaped members, each fork-shaped member receiving a shaft with ring-shaped rolling bodies rotatably mounted on each shaft, further comprising a base plate, the base plate having a center and a transverse direction, the handle being connected to the base plate so as to extend from the center and in transverse direction, the base plate comprising a plurality of pockets, the fork-shaped members being received in the pockets, the fork-shaped members defining oblong slots and the pockets having projecting bolts engaging in the oblong slots, wherein the fork-shaped members are arranged on the base plate in at least two rows extending parallel to each other.

9. The massage device according to claim 8, wherein the fork-shaped members are arranged in three rows on the base plate, and wherein two fork-shaped members each are arranged in axial direction next to each other in two outer rows and one fork-shaped member is arranged in a middle row and staggered relative to the fork-shaped members of the outer rows.

10. The massage device according to claim 1, wherein the spring comprises a plurality of helical compression springs.

* * * * *